US009671103B2

(12) United States Patent
Chao

(10) Patent No.: US 9,671,103 B2
(45) Date of Patent: Jun. 6, 2017

(54) ENERGY-SAVING AND HIGH BRIGHTNESS LIGHTING FIXTURE

(71) Applicant: Wen-Hsin Chao, Changhua (TW)

(72) Inventor: Wen-Hsin Chao, Changhua (TW)

( * ) Notice: Subject to any disclaimer, the term of this patent is extended or adjusted under 35 U.S.C. 154(b) by 100 days.

(21) Appl. No.: 14/578,463

(22) Filed: Dec. 21, 2014

(65) Prior Publication Data

US 2016/0178185 A1 Jun. 23, 2016

(30) Foreign Application Priority Data

Jan. 20, 2014 (CN) ..... 2014 2 0036005 U

(51) Int. Cl.

| | |
|---|---|
| ***F21K 99/00*** | (2016.01) |
| ***F21V 29/77*** | (2015.01) |
| ***F21K 9/23*** | (2016.01) |
| *F21V 23/00* | (2015.01) |
| *F21K 9/235* | (2016.01) |
| *F21K 9/238* | (2016.01) |
| *F21K 9/237* | (2016.01) |
| *F21Y 115/10* | (2016.01) |

(52) U.S. Cl.

CPC ..... *F21V 29/773* (2015.01); *F21K 9/23* (2016.08); *F21K 9/235* (2016.08); *F21K 9/237* (2016.08); *F21K 9/238* (2016.08); *F21V 23/002* (2013.01); *F21V 23/006* (2013.01); *F21Y 2115/10* (2016.08)

(58) Field of Classification Search

CPC ..... F21K 9/13; F21K 9/135; F21K 9/1375
USPC ..... 362/249.02, 363, 373, 455, 294
See application file for complete search history.

(56) References Cited

U.S. PATENT DOCUMENTS

| | | | | |
|---|---|---|---|---|
| 2007/0069849 | A1* | 3/2007 | Furukawa | G01R 33/093 338/32 R |
| 2010/0177522 | A1* | 7/2010 | Lee | F21K 9/135 362/373 |
| 2010/0186937 | A1* | 7/2010 | Liang | F21V 29/85 165/185 |
| 2011/0050133 | A1* | 3/2011 | Grajcar | F21V 29/83 315/307 |
| 2011/0080732 | A1* | 4/2011 | Chen | F21K 9/1355 362/249.02 |
| 2012/0187818 | A1* | 7/2012 | Chuang | F21V 29/83 313/46 |
| 2013/0136454 | A1* | 5/2013 | Yu | H05B 33/0803 398/106 |

(Continued)

*Primary Examiner* — Renee Chavez
*Assistant Examiner* — Zheng Song
(74) *Attorney, Agent, or Firm* — Che-Yang Chen; Law Offices of Scott Warmuth

(57) ABSTRACT

An energy-saving and high brightness lighting fixture includes a light cover, a circular plate, a light-collecting lens, a housing body and an electronic device. The light cover is tubular with a plurality of heat sinks and a cooling tank. A circular plate is riveted with light cover's engaging portion, and an LED lamp is disposed on it. A light-collecting lens is disposed on the top of the light cover. A housing body's surface with fixture block and limiting strip, which housing body is inserted in the restricting groove by limiting strip and using fixture block to fix at ring groove of light cover. An electronic device has a main circuit board and at least one auxiliary circuit board, and electronic device can be inserted inside the light cover to reduce the volume and enhance the cooling effect.

6 Claims, 8 Drawing Sheets

(56) References Cited

U.S. PATENT DOCUMENTS

| | | | | |
|---|---|---|---|---|
| 2013/0155695 | A1* | 6/2013 | Liu | F21V 29/006 362/373 |
| 2013/0188370 | A1* | 7/2013 | Koch | F21K 9/1375 362/364 |
| 2014/0063809 | A1* | 3/2014 | Huang | F21K 9/1355 362/294 |
| 2014/0153259 | A1* | 6/2014 | Lee | F21K 9/135 362/363 |
| 2014/0218932 | A1* | 8/2014 | Huang | F21K 9/135 362/294 |

* cited by examiner

ENERGY-SAVING AND HIGH BRIGHTNESS LIGHTING FIXTURE

FIELD OF THE INVENTION

The present invention is related to an LED lighting fixture, and more particularly to a high brightness lighting fixture with compact size and enhanced cooling effect.

BACKGROUND OF THE INVENTION

A structure of spotlight, characterized in the LED 61 is assembled on the LED unit structure 60, which the LED unit structure 60 has driving electronic device 62, and the LED unit structure 60 connects to heat conducting part 63 to cool the heat. Furthermore, the LED unit structure 60 connects to the LED driving device 64, which LED driving device lock sets cooling part of driving device 65 to cool the heat. Above-mentioned units all set at clamp 70 and fixed, and are put into housing 80 by clamp 70. Lens unit 81 and front panel 82 cover housing 80 to make its composition, and LED 61's light penetrates lens unit 81 projecting. However, above-mentioned structure still has some problems can be improved, these are the main problems: 1. The LED unit structure 60 and LED driving device 64 are both circular circuit board, which is used to provide a large amount of electronic unit composition, and has bigger volume, it makes housing 80 needs to be bigger to set LED unit structure 60 and LED driving device 64 inside. It has the obvious problem that the product is not small enough. 2. LED 61 and driving electronic device 62 are set at same LED unit structure 60. When using LED 61 will generate a large amount heat and conduct to driving electronic device 62 directly, it makes driving electronic device 62 easier to damage by overheating, also, the LED unit structure 60 can cool down efficient, which makes the problem of undesired cooling effect. 3. LED unit structure 60 and LED driving device 64 are both exposed to the air. It causes the problems of unstable structure and effect of sulfation, which affect its durability. 4. LED unit structure 60 and LED driving device 64 are separately connect to heat conducting part 63 and cooling part of driving device 65 to cool down. However, the cooling structure is fully covered by housing 80, lens unit 82 and front panel 82. It makes the high temperature air cannot convective heat transfer. Furthermore, heat conducting part 63 and cooling part of driving device 65 has not enough cooling area, and LED 61 does not have LED driving device 64 to make effective heat barrier. It causes the whole structure overheated and might make LED driving device 64 damages, which has the problem of cooling down.

Therefore, there remains a need for a new and improved LED lighting device to overcome the problems stated above.

SUMMARY OF THE INVENTION

To solve the problems stated above, the present invention provides an energy-saving and high-brightness lighting fixture.

The energy-saving and high-brightness lighting fixture may include an integrally molded aluminum light cover, which is tubular with plurality of heat sinks on outer ring, and outside the connected light cover has a cooling tank, wherein, inside the light cover has a ring groove transverse, at least a restricting groove longitudinal. The ring groove near the bottom of light cover, an engaging portion is at the top of the light cover. A circular plate is riveted with light cover's engaging portion, and a LED lamp set on it. A light-collecting lens is set on the top of the light cover. A housing body's surface with fixture block and plurality limiting strip, which housing body is inserted in the restricting groove by limiting strip and using fixture block to fix at ring groove of light cover, it makes the light cover only contact with fixture block and housing. An electronic device is composed by a main circuit board and at least one auxiliary circuit board, and the auxiliary circuit board is vertically set on main circuit board, it makes electronic device can be set inside the light cover and control LED lamp.

In one embodiment, heat sink on the top of the housing has outer thread outside, and the light collecting lens is fixed by a fixed ring, which the fixed ring has a inner thread inside to make fixed ring can lock set with heat sink's outer thread.

In another embodiment, the circular plate stick LED lamps with adhesive strip. In still another embodiment, the electronic device on main circuit board has a groove, and the surface of the housing has plurality electrical connection contact points, and the electronic device contacts with these electrical connection contact points.

In a further embodiment, the housing is filled with adhesive strip inside. In still a further embodiment, the electronic device contacts with protection capacitance, and the protection capacitance conducts with electronic device output point on one side and contact with wire on the other side. The wire sets between housing and light cover. Doing the test of high voltage insulation resistance, the high voltage current can come around LED lamp have conducting loop with protection capacitance. It has high voltage insulation function and protect LED lamp.

In still a further embodiment, the electronic device connects with a magnetic resistance to eliminate noise.

The main objective of the present invention is making auxiliary circuit board vertically disposed on the main circuit board to decrease the volume of the electronic device, so the electronic device can be inserted into housing to decrease the volume of the product.

The second objective of the present invention is to provide space for the electronic device inside the housing and filled the housing with adhesive strip, which can make electronic device covered by adhesive strip and fixed. Furthermore, using adhesive strip's heat conduction to enhance the cooling effect of electronic device and using vacuum state to eliminate sulfation of electronic device.

The third objective of the present invention is that the housing is fixed at light cover's ring groove through the fixture block, and the circular plate is riveted at light cover's engaging portion, moreover, the fixing ring is set at heat sink's outer thread by inner thread, which can compose the structure faster and make a composition without contact point, and increase the product's additional value.

The forth objective of the present invention is that the housing's limiting strip combine with light cover's restricting groove and make anti-rotation effect. The housing is fixed at light cover's ring groove by fixture block, which can make housing and light cover partly contact with fixture block, it can decrease a lot contact area and have great heat insulation effect, so the electronic device will not be affected by the LED lamp's heat to increase its durability.

The fifth objective of the present invention is that an integrally molded aluminum light cover, which is tubular with plurality of hollow heat sinks on outer ring, it can make air follow through these heat sinks, also, the light cover contact with cooling tank, it can enhance the cooling effect of light cover.

The sixth objective of the present invention is that the circular plate contacts LED lamps with adhesive strip, filling their pores to enhance heat conduction effect.

DETAILED DESCRIPTION OF THE INTENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristic and effect of the present invention, a number of embodiments along with the drawings are illustrated as following.

Figure 1:
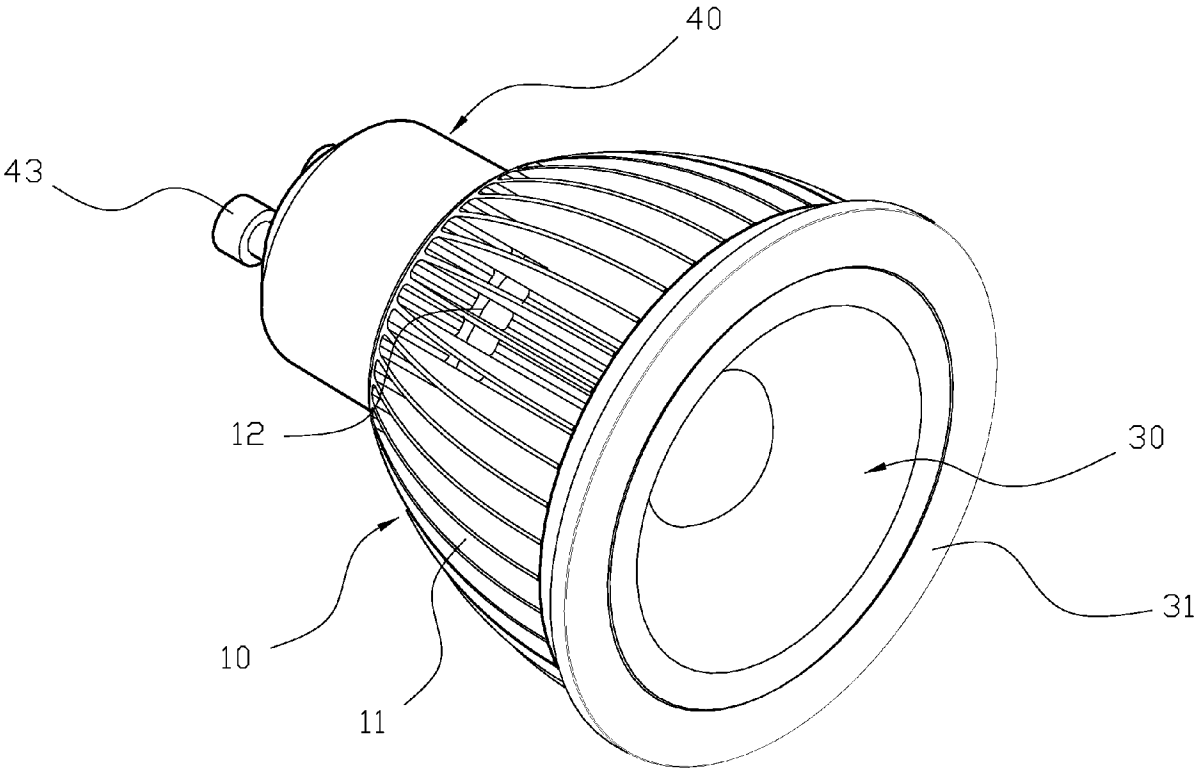
FIG. 1 illustrates a three-dimensional view of the present invention.
Figure 2:
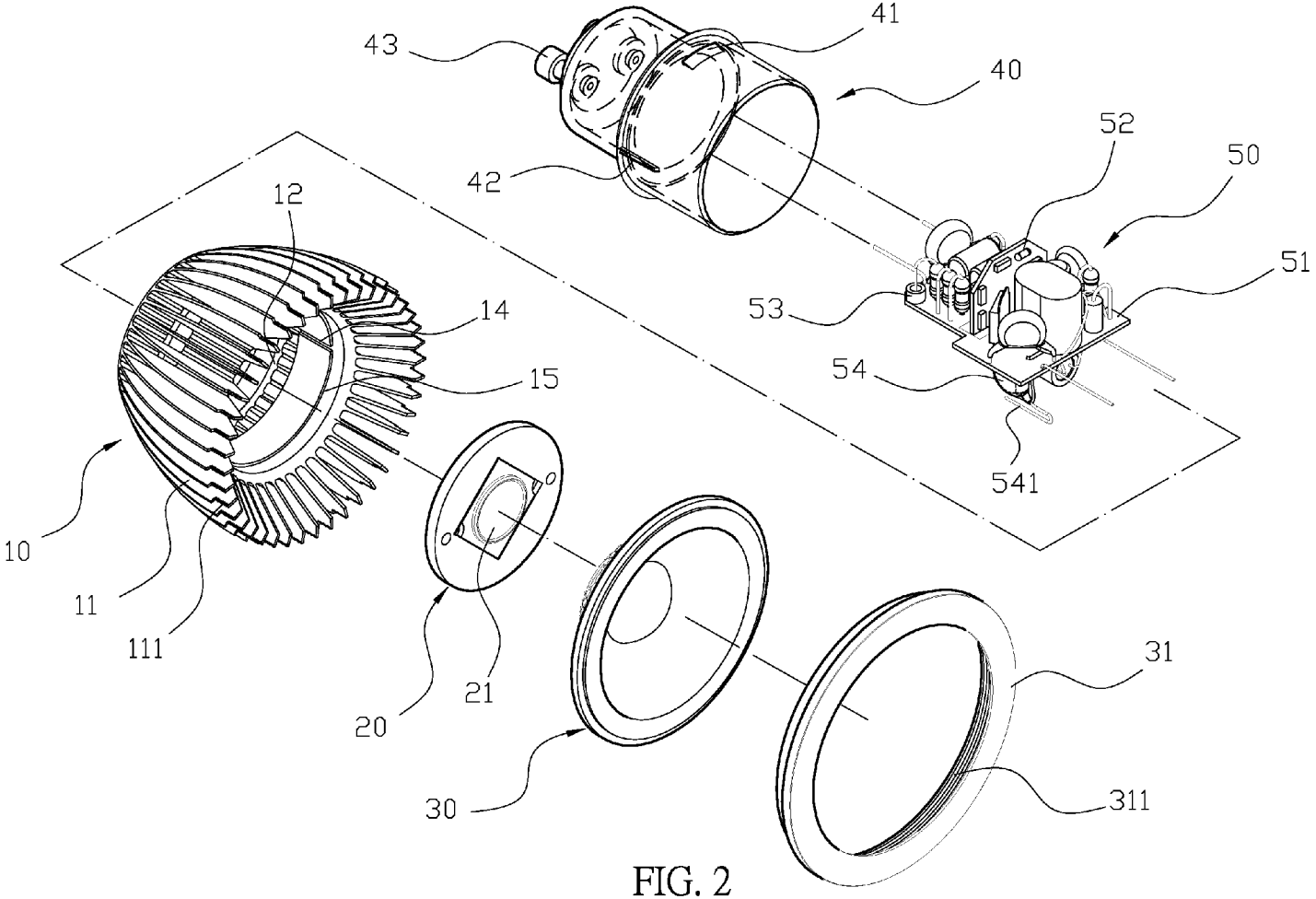
FIG. 2 illustrates a three-dimensional exploded view of the present invention.
Figure 3:
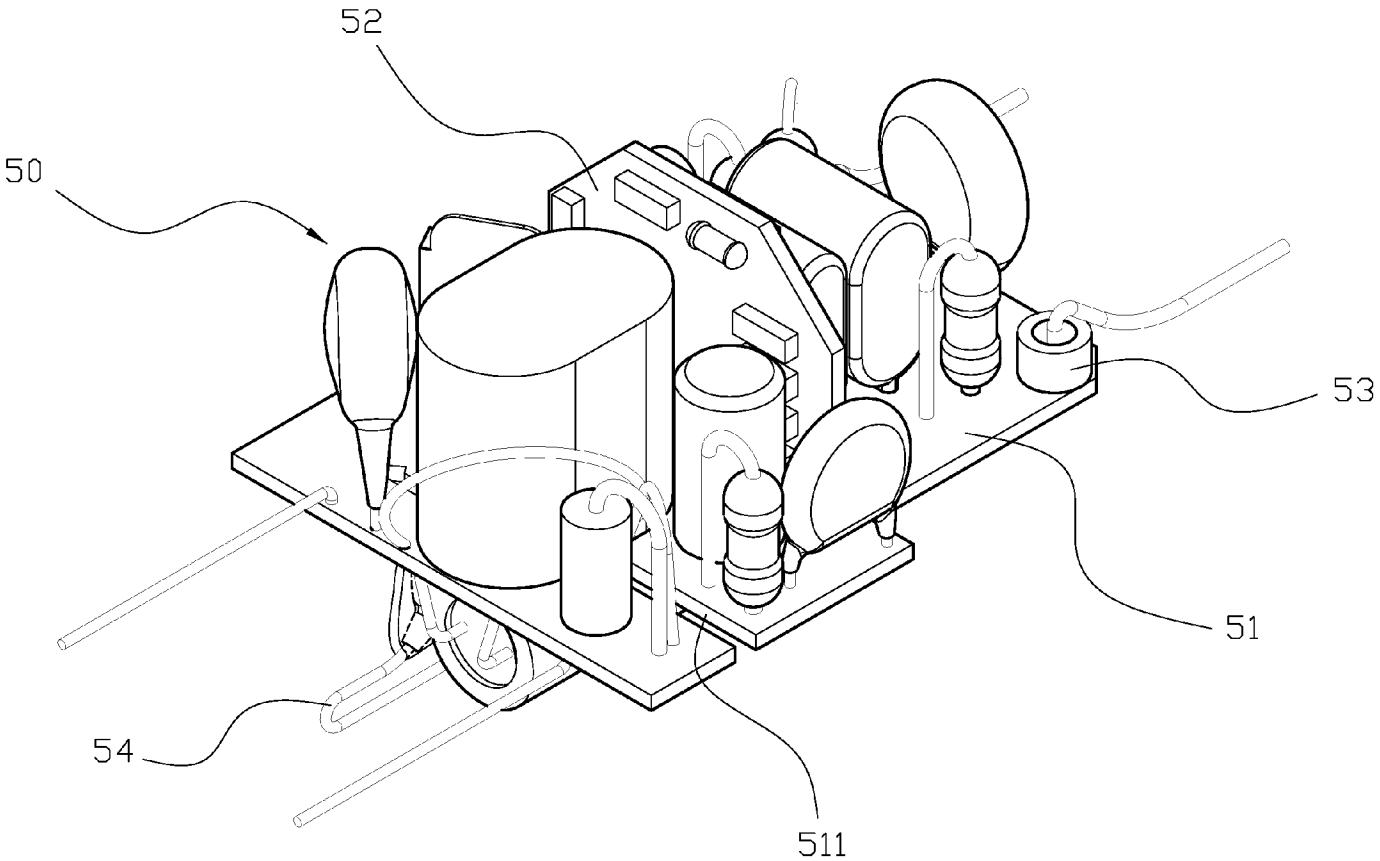
FIG. 3 illustrates a three-dimensional view of the electronic device in the present invention.
Figure 4:
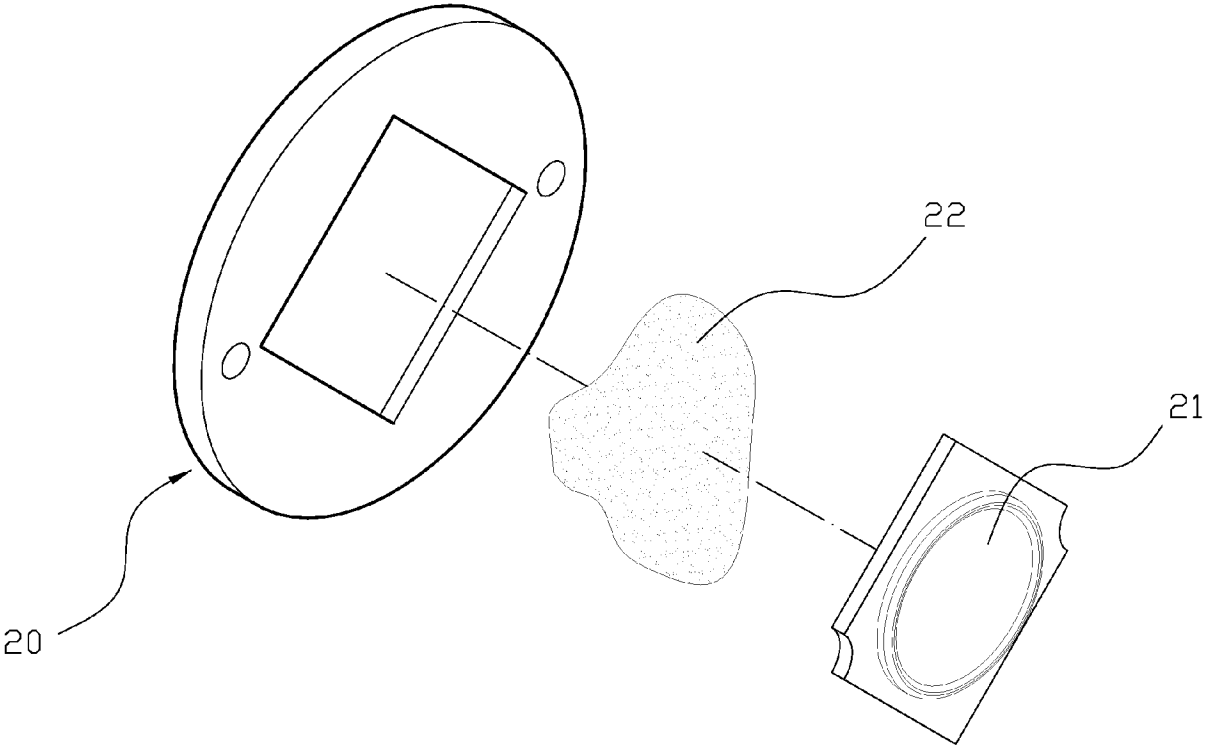
FIG. 4 illustrates a three-dimensional view of the LED lamp in the present invention.
Figure 5:
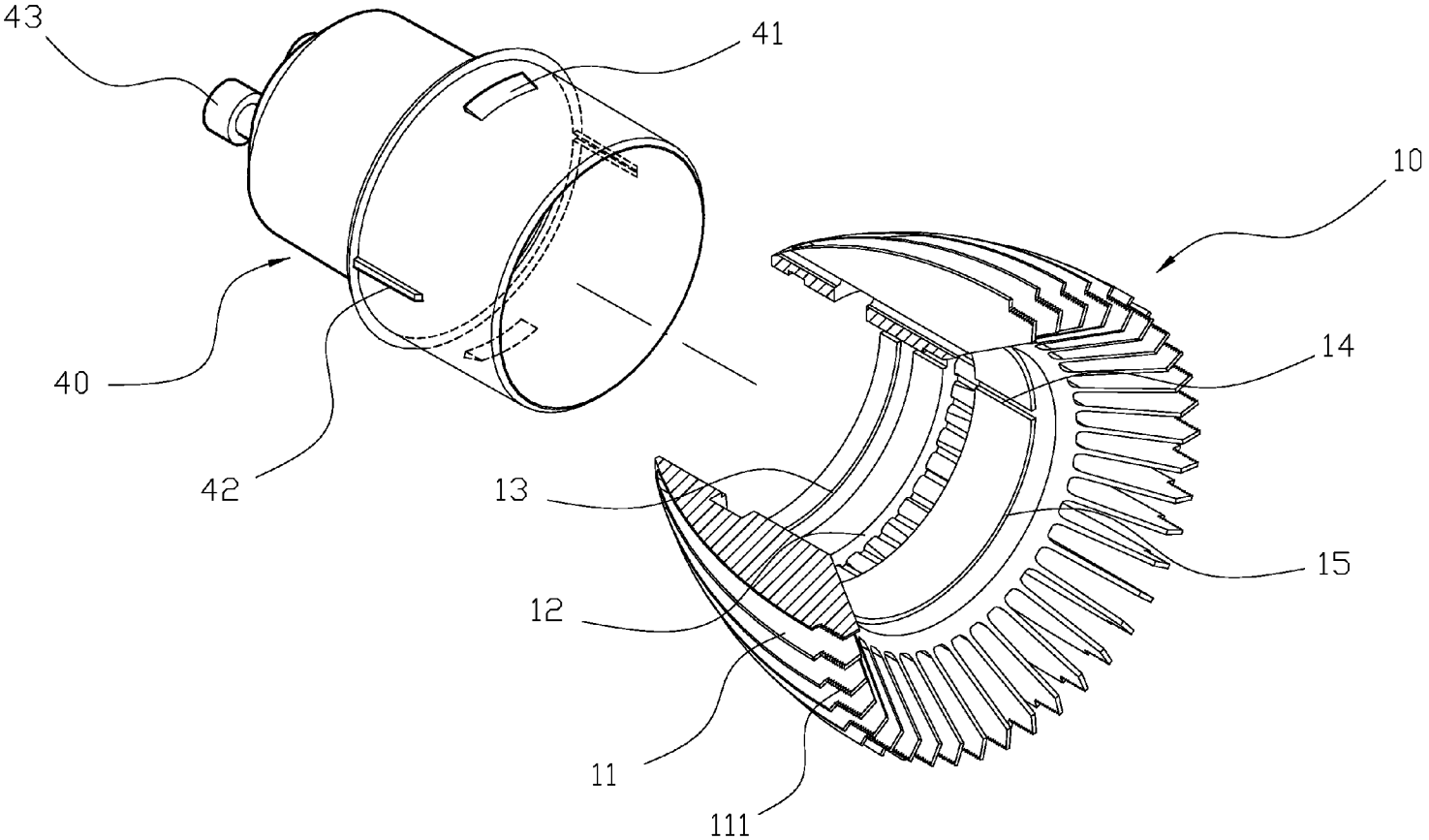
FIG. 5 illustrates a schematic view of the light cover and housing body in the present invention.
Figure 6:
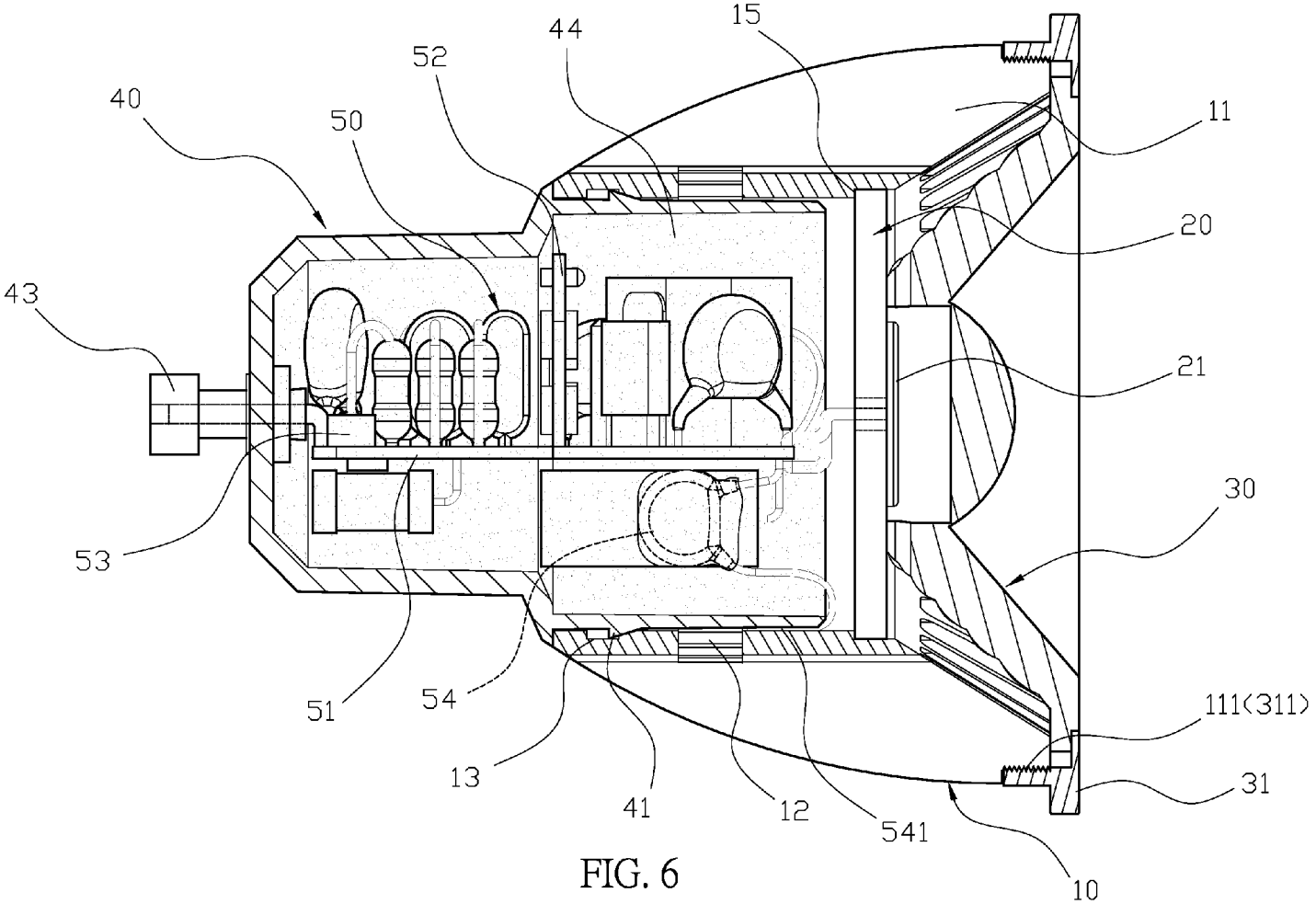
FIG. 6 illustrates a longitudinal sectional view of the present invention.
Figure 7:
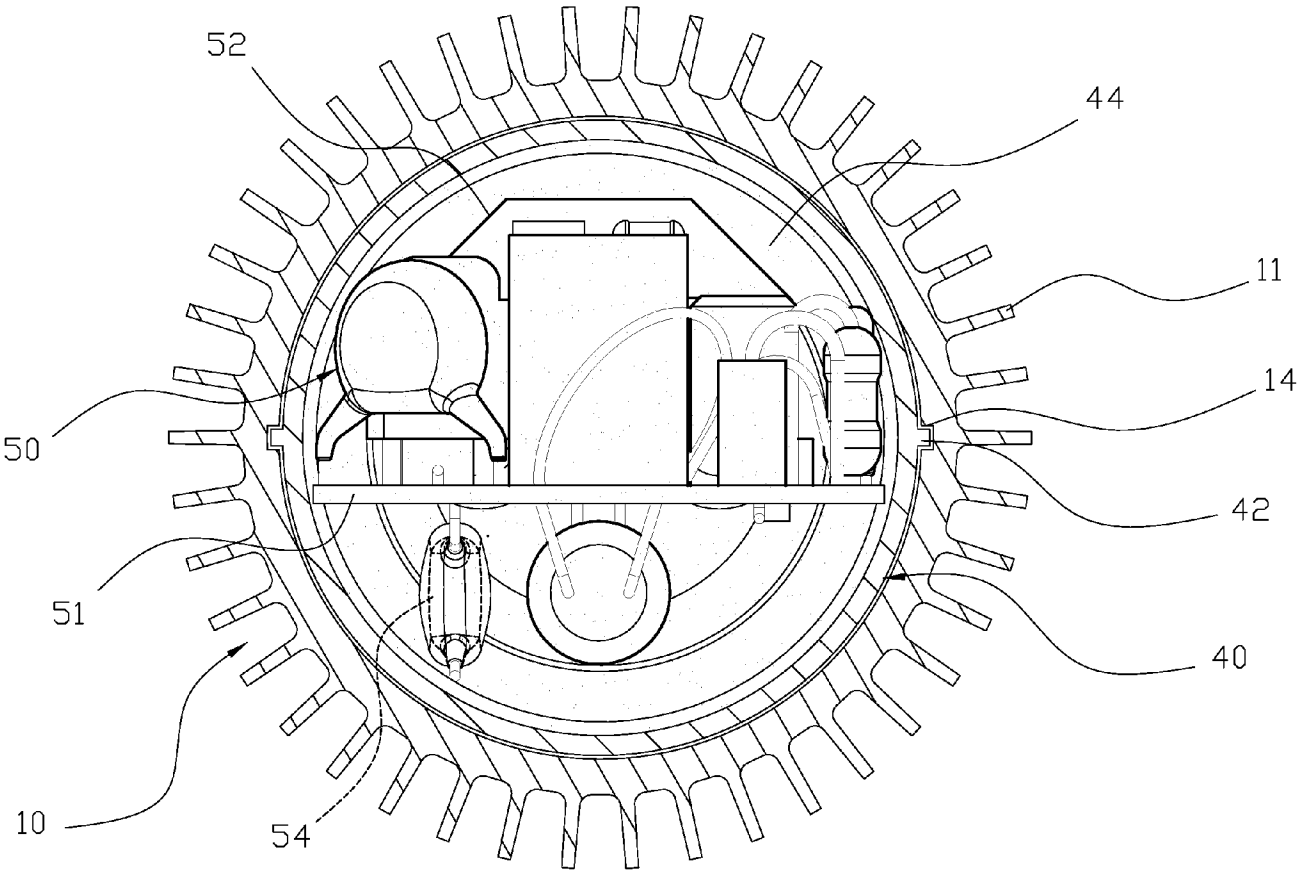
FIG. 7 illustrates a transverse sectional view of the present invention.
Figure 8:
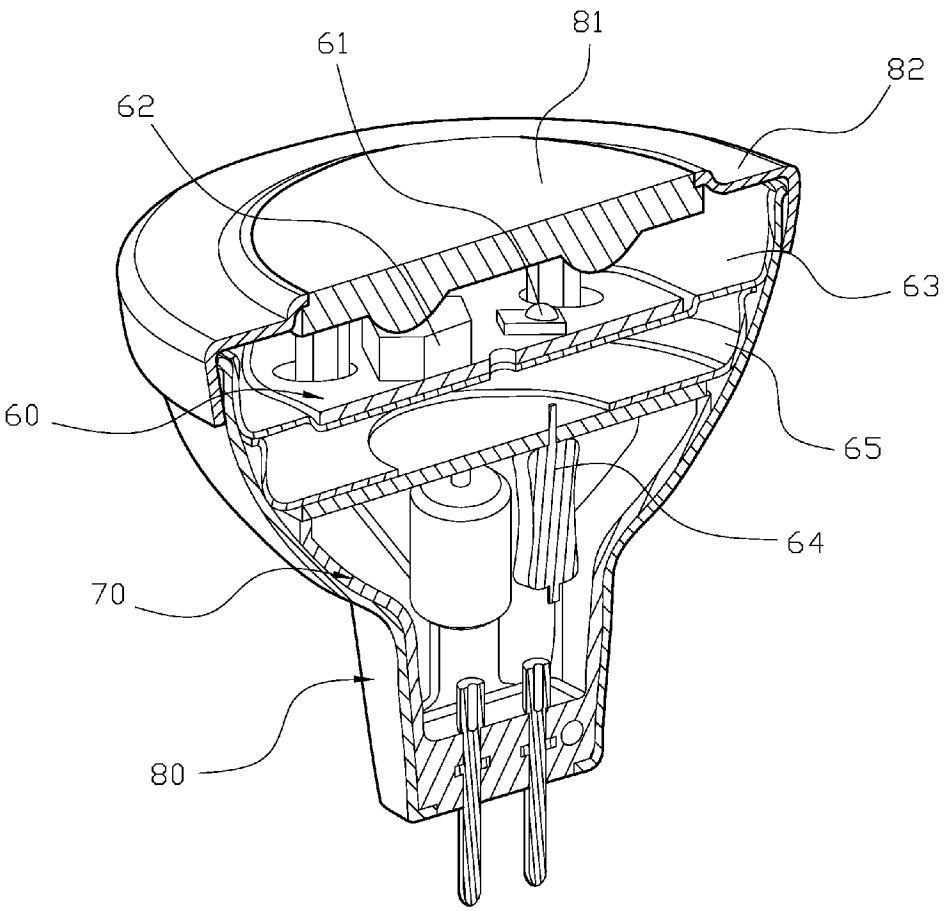
FIG. 8 PRIOR ART
FIG. 8 illustrates a cross-sectional view of the LED lamp in the prior art.

Referring to FIGS. 1-7, a structure of energy saving and high brightness spotlight, it includes: a light cover 10, a circular plate 20, a light collecting lens 30, a housing 40 and an electronic device 50. An integrally molded aluminum light cover 10, which is tubular with plurality of heat sinks 11 on outer ring, and outside the connected light cover 10 has a cooling tank 12. Heat sink 11 and cooling tank 12 can enhance the cooling effect of light cover 10. In one embodiment, inside the light cover 10 has a ring groove 13 transverse, at least a restricting groove 14 longitudinal. The ring groove 13 near the bottom of light cover 10, an engaging portion 15 is at the top of the light cover 10. A circular plate 20 is riveted with light cover 10's engaging portion 15, and a LED lamp 21 set on it. Wherein the circular plate 20 contacts LED lamps 21 with adhesive strip 22, filling their pores to enhance heat conduction effect. A light-collecting lens 30 is set on the top of the light cover 10, and makes LED lamp 21's light focus to project. Wherein the light collecting lens 30 is fixed by a fixed ring 31, which the fixed ring 31 has a inner thread 311 inside to make fixed ring 31 can lock set with heat sink's outer thread 111. A housing body 40's surface with plurality fixture blocks 41 and limiting strips 42, which housing body 40 is inserted in the restricting groove 14 by limiting strip 42. The housing 40's limiting strip 42 is inserted in restricting groove 14 and make anti-rotation effect. Using fixture block 41 to fix at ring groove 13 of light cover 10, it makes the light cover 10 only contact with fixture block 41 and housing 40, and have better heat insulation effect. Also, the housing 40's surface has plurality electrical connection contact points 43, and the electronic device 50 contacts with these electrical connection contact points 43. An electronic device 50 is vertically composed by a main circuit board 51 and at least one auxiliary circuit board 52, wherein the electronic device 50 on main circuit board 51 has a groove 511, which can make electrical barrier. Furthermore, the auxiliary circuit board 52 vertically sets on main circuit board 51 and decreases the volume of electronic device 50. It makes electronic device 50 can be set inside the housing 40, and controls LED lamp 21 by electronic device 50. Housing 40 filled with adhesive strip 44 inside which fixes electronic device 50 and make cooling effect. Also, the adhesive strip 44 can make electronic device 50 vacuum insulated, and make electrolyte of capacitance cannot volatilize. Whereby preventing electronic device 50 has sulfation, then service life can be effectively prolonged, furthermore, it decreases the volume of product and enhances the cooling effect.

In order to understand the structure of composition, referring to FIGS. 1-7, an electronic device 50 is connect with electrical connection contact point 43 of housing 40. In order to decrease the volume of electronic device 50 and make it easier to set inside the housing 40, main circuit board 51 and auxiliary circuit board 52 compose vertically. Using adhesive strip 44 to fill housing 40 and make electronic device 50 vacuums, which can make electronic device 50 cover by adhesive strip 44 and fixed. Moreover, using adhesive strip 44 can enhance heat conduction and eliminate sulfation of electronic device. The housing 40's limiting strip 42 is inserted in restricting groove 14 and make anti-rotation effect. Using fixture block 41 of housing 40 to fix at ring groove 13 of light cover 10, then it makes housing 40 partly contact and fix with light cover 10. Also, the electronic device 50 contact with LED lamp 21 of circular plate 20. In order to make electronic device 50 control LED lamp 21, it has to generate electrical connection contact point 43 and conduct with LED lamp 21. A circular plate 20 is riveted with light cover 10's engaging portion 15, then a light collecting lens 30 set on the front of LED lamp 21 of light cover 10 and lock set at outer thread 111 of heat sink 11 by inner thread 311 of fixing ring 31, which can fix light collecting lens 30 and make the light of LED lamp 21 focus to project. According to the embodiments mentioned-above can get the conclusions: (I) In order to decrease the volume of electronic device 50 and make it easier to set inside the housing 40, main circuit board 51 and auxiliary circuit board 52 compose vertically. (II) Providing space for electronic device 50 inside the housing 40 and using adhesive strip 44 to fill with housing 40, which can make electronic device 50 can be covered by adhesive strip 44 and fixed. Furthermore, using adhesive strip's heat conduction to enhance the cooling effect of electronic device and using vacuum state to eliminate sulfation of electronic device. (III) The housing 40 is fixed at light cover 10's ring groove 13 by fixture block 41, and the circular plate 20 is riveted at light cover 10's engaging portion 15, moreover, the fixing ring 31 is set at heat sink 11's outer thread 111 by inner thread 311, which can compose the structure faster and make a composition without contact point, and increase the product's additional value. (IV) The housing 40's limiting strip 42 combine with light cover 10's restricting groove 14 and make anti-rotation effect. The housing 40 is fixed at light cover 10's ring groove 13 by fixture block 41, which can make housing 40 and light cover 10 partly contact with fixture block 41, it can decrease a lot contact area and have great heat insulation effect, and make electronic device 50 will not affect by LED lamp 21's heat to increase its durability. (V) An integrally molded aluminum light cover 10, which is tubular with plurality of hollow heat sinks 11 on outer ring, it can make air follow through these heat sinks 11, also, the light cover 10 contact with cooling tank 12, it can enhance the cooling effect of light cover. (VI) The circular plate 20 contacts LED lamps 21 with adhesive strip 22, filling their pores to enhance heat conduction effect.

Furthermore, referring to FIGS. 2-6, the electronic device 50 connects with a magnetic resistance 53 to eliminate noise. In order to eliminate noise effectively and enhance its stability, making electrical connection contact point 43 contact with current of electronic device 50 and filter by magnetic resistance 53. The present invention fixing LED lamp 21 at high conductive circular plate 20 to decrease LED lamp 21's temperature. If insulation is not enough and will let external high voltage current easy to flashover from LED lamp 21 to light cover 10, it will damage LED lamp 21 and cannot pass through high voltage test. Therefore, the electronic device 50 connect with protection capacitance 54, and protection capacitance 54 electrically conduct with electronic device 50 on one side and connect with wire 541 on the other side. Wherein, wire 541 is between housing 40 and light cover 10, it makes capacitance of protection capacitance 54 is at least bigger than five times of electronic device 50's capacitance, which make protection capacitance 54 is not connecting at usual condition. It will not affect using and controlling LED lamp 21. If we are doing high voltage insulation test from electrical connection contact point 43 to light cover 10, the high voltage current will choose the route from electrical connection contact point 43 pass through electronic device 50 to wire 541 to connect protection capacitance 54. Using protection capacitance 54 to lead high voltage current to light cover 10, it makes external high voltage current can pass LED lamp 21 and connect with protection capacitance 54. It can prevent high voltage current go through LED lamp 21, and protect LED lamp 21 by protection capacitance 43.

Having described the invention by the description and illustrations above, it should be understood that these are exemplary of the invention and are not to be considered as limiting. Accordingly, the invention is not to be considered as limited by the foregoing description, but includes any equivalents.

What claimed is:

1. An energy-saving and high brightness lighting fixture comprising:

a light cover made of aluminum in one piece, having a heat sink with a plurality of heat sink fins radially disposed on an outer portion thereof and a cooling tank;

a ring groove transversely formed inside the light cover and at least one restricting groove vertically formed therein, and the ring groove disposed near a bottom portion of the light cover, and an engaging portion disposed at a top portion of the light cover;

a circular plate having an outer portion which engages the engaging portion of the light cover, and an LED lamp disposed on a surface of the circular plate;

a light-collecting lens disposed at a top portion of the light cover to concentrate the light from the LED lamp;

a housing body having a plurality of fixture blocks and limiting strips located on a continuous ring surface, said housing body inserted in the restricting groove, and the limiting strip plugging into the restricting groove to prevent rotation of the light cover when connected to the housing body; the fixture blocks engaging with only said ring groove of the light cover inside the housing body to have a better heat insulating effect; and an electronic device having a main circuit board and at least one auxiliary circuit board vertically disposed with respect to the main circuit board, which is disposed vertically within the light cover, to reduce the size of the electronic device, so the electronic device is configured to be disposed in the light cover and control the LED lamp.

2. The energy-saving and high brightness lighting fixture of claim 1, wherein the heat sink by the top of the housing body has an outer thread, and the light collecting lens is fixed to the heat sink by a fixing ring, wherein the fixing ring has an inner thread inside to lock with the heat sink outer thread.

3. The energy-saving and high brightness lighting fixture of claim 1, wherein the main circuit board has a groove.

4. The energy-saving and high brightness lighting fixture of claim 1, wherein a housing body surface has plurality electrical connection contact points, and the electronic device is connected to the electrical connection contact points.

5. The energy-saving and high brightness lighting fixture of claim 1, wherein the housing is filled with adhesive inside which fixes the electronic device.

6. The energy-saving and high brightness lighting fixture of claim 1, wherein the electronic device is configured to be connected with a magnetic resistor to eliminate noise.

* * * * *